US007853188B2

(12) United States Patent
Watanabe et al.

(10) Patent No.: US 7,853,188 B2
(45) Date of Patent: Dec. 14, 2010

(54) IMAGE FORMING APPARATUS AND IMAGE FORMING METHOD

(75) Inventors: Takeshi Watanabe, Kanagawa-ken (JP); Minoru Yoshida, Tokyo (JP); Masashi Takahashi, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 898 days.

(21) Appl. No.: 11/621,814

(22) Filed: Jan. 10, 2007

(65) Prior Publication Data

US 2008/0166159 A1 Jul. 10, 2008

(51) Int. Cl.

| | |
|---|---|
| ***G03G 15/06*** | (2006.01) |
| ***G03G 15/08*** | (2006.01) |
| ***G03G 15/01*** | (2006.01) |
| ***G03G 9/00*** | (2006.01) |
| ***G03G 13/16*** | (2006.01) |

(52) U.S. Cl. ..... 399/302; 399/222; 399/252; 399/281; 399/303; 430/114.4; 430/125.32; 430/125.33

(58) Field of Classification Search ..... 399/222, 399/252, 281, 302; 430/111.4, 125.32, 125.33
See application file for complete search history.

(56) References Cited

U.S. PATENT DOCUMENTS

| | | | | |
|---|---|---|---|---|
| 5,370,961 | A * | 12/1994 | Zaretsky et al. | 430/125.32 |
| 5,519,475 | A * | 5/1996 | Miyamoto et al. | 399/308 |
| 5,827,632 | A * | 10/1998 | Inaba et al. | 430/108.6 |
| 6,875,549 | B2 * | 4/2005 | Yamazaki et al. | 430/106.1 |
| 7,209,690 | B2 * | 4/2007 | Koyanagi et al. | 399/279 |
| 2006/0120773 | A1 * | 6/2006 | Itami et al. | 399/302 |
| 2006/0159494 | A1 * | 7/2006 | Hirai et al. | 399/303 |
| 2006/0172097 | A1 * | 8/2006 | Morikoshi et al. | 428/35.7 |
| 2006/0210309 | A1 | 9/2006 | Yoshida et al. | |
| 2006/0210322 | A1 | 9/2006 | Watanabe et al. | |
| 2008/0166158 | A1 | 7/2008 | Takahashi et al. | |

FOREIGN PATENT DOCUMENTS

| | | |
|---|---|---|
| JP | 52-126230 | 10/1977 |
| JP | 07-295325 | 11/1995 |
| JP | 2002-304066 | 10/2002 |
| JP | 2002296898 A * | 10/2002 |

(Continued)

*Primary Examiner*—David M Gray
*Assistant Examiner*—Francis Gray
(74) *Attorney, Agent, or Firm*—Turocy & Watson, LLP

(57) ABSTRACT

A technology capable of suppressing the generation of transfer scattering of a toner image on an intermediate transfer body and contributing to an improvement in image quality in an image forming apparatus employing an intermediate transfer system is provided. An image forming apparatus is configured to include an intermediate transfer body to which a toner imager is transferred from an image carrier, the intermediate transfer body having an elastic surface layer having a center point average roughness of 0.1 times or more of a volume average particle size of a used toner and a ten-point average roughness of not more than the volume average particle size of the used toner; and a development section which develops an electrostatic latent image on the image carrier by using a toner having a shape factor SF-1 in the range of from 100 to 130 and a shape factor SF-2 in the range of from 100 to 140.

12 Claims, 12 Drawing Sheets

FOREIGN PATENT DOCUMENTS

| | | | | |
|---|---|---|---|---|
| JP | 2003-029550 | | | 1/2003 |
| JP | 2003-156949 | | | 5/2003 |
| JP | 2003-215943 | | | 7/2003 |
| JP | 2005272796 | A | * | 10/2005 |
| JP | 2005283928 | A | * | 10/2005 |
| JP | 2006010921 | A | * | 1/2006 |
| JP | 2006-084982 | | | 3/2006 |

* cited by examiner

LINE DENSITY
ID>1.0

IDEAL STATE

FIG.10

| | | Shape factor of toner | | SF-1:110, SF-2:110 | | | | | | SF-1:130, SF-2:130 | | | | | |
|---|---|---|---|---|---|---|---|---|---|---|---|---|---|---|---|
| | | | | Primary transfer | | | Secondary transfer | | | Primary transfer | | | Secondary transfer | | |
| | | Average particle size of toner (μm) ⇒ | | 5.2 | 7.2 | 9.3 | 5.2 | 7.2 | 9.3 | 5.2 | 7.2 | 9.3 | 5.2 | 7.2 | 9.3 |
| | | Thickness of surface layer (μm) | Hardness of elastic layer (Asker-C) | Line width (ID: 0.2 to 1.0) μm | | | Transfer efficiency (%) | | | Line width (ID: 0.2 to 1.0) μm | | | Transfer efficiency (%) | | |
| Belt 2 | Preparation Example 1 | 200 | 50 | 33 | 59 | 69 | 97 | 97.4 | 97.2 | 25 | 34 | 35 | 94.5 | 95.5 | 95.2 |
| Belt 38 | Preparation Example 1 | 200 | 10 | 33 | 58 | 68 | 98 | 97 | 97 | 26 | 34 | 34 | 95 | 95.5 | 95 |
| Belt 18 | Preparation Example 2 | 200 | 50 | 31 | 57 | 69 | 97.1 | 97.4 | 97.1 | 24 | 34 | 34 | 95 | 95.3 | 95.2 |
| Belt 23 | Preparation Example 2 | 100 | 50 | 32 | 58 | 68 | 97 | 97.1 | 97.1 | 25 | 35 | 35 | 94.7 | 95.5 | 95.2 |
| Belt 28 | Preparation Example 2 | 200 | 80 | 33 | 59 | 69 | 96.5 | 96.8 | 97 | 25 | 35 | 35 | 94.5 | 95.7 | 95.2 |
| Belt 33 | Polyimide single layer | | >90 | 51 | 64 | 69 | 92 | 92 | 91 | 31 | 36 | 37 | 90 | 89 | 90 |
| Belt 3 | Preparation Example 1 | 200 | 50 | 31 | 33 | 55 | 97 | 97.4 | 97.2 | 24 | 26 | 34 | 94.5 | 95.5 | 95.2 |
| Belt 39 | Preparation Example 1 | 200 | 10 | 32 | 33 | 55 | 97 | 97.5 | 97 | 24 | 26 | 34 | 95 | 95.5 | 95 |
| Belt 19 | Preparation Example 2 | 200 | 50 | 31 | 34 | 55 | 97 | 97.4 | 97.1 | 24 | 26 | 34 | 95 | 95.3 | 95.2 |
| Belt 24 | Preparation Example 2 | 100 | 50 | 32 | 35 | 55 | 97 | 97 | 97.1 | 25 | 26 | 34 | 94.7 | 95.5 | 95.2 |
| Belt 29 | Preparation Example 2 | 200 | 80 | 32 | 35 | 56 | 96.4 | 96.9 | 97 | 25 | 27 | 34 | 94.5 | 95.7 | 95.2 |
| Belt 34 | Polyimide single layer | | >90 | 50 | 51 | 66 | 92 | 91 | 90 | 31 | 32 | 37 | 89 | 90 | 89 |
| Belt 12 | Preparation Example 1 | 200 | 50 | 62 | 67 | 70 | 96.5 | 97.5 | 97.2 | 35 | 35 | 36 | 92.5 | 93.5 | 93.2 |
| Belt 20 | Preparation Example 2 | 200 | 50 | 61 | 67 | 70 | 96 | 97 | 97 | 34 | 35 | 36 | 93 | 93 | 93 |

FIG.11

| | | Shape factor of toner | | SF-1:110, SF-2:110 | | | | | | SF-1:130, SF-2:130 | | | | | |
|---|---|---|---|---|---|---|---|---|---|---|---|---|---|---|---|
| | | | | Primary transfer | | | Secondary transfer | | | Primary transfer | | | Secondary transfer | | |
| | | Average particle size of toner (μm) ⇒ | | 5.2 | 7.2 | 9.3 | 5.2 | 7.2 | 9.3 | 5.2 | 7.2 | 9.3 | 5.2 | 7.2 | 9.3 |
| | | Thickness of surface layer (μm) | Hardness of elastic layer (Asker-C) | Line width (ID: 0.2 to 1.0) μm | | | Transfer efficiency (%) | | | Line width (ID: 0.2 to 1.0) μm | | | Transfer efficiency (%) | | |
| Belt 25 | Preparation Example 2 | 100 | 50 | 62 | 67 | 71 | 96.5 | 97 | 97 | 35 | 35 | 37 | 92 | 93 | 93 |
| Belt 30 | Preparation Example 2 | 200 | 80 | 63 | 68 | 71 | 96 | 97 | 97 | 35 | 36 | 37 | 92 | 92 | 93 |
| Belt 35 | Polyimide single layer | | >90 | 66 | 71 | 72 | 92 | 91 | 91 | 37 | 37 | 38 | 89 | 90 | 89 |
| Belt 13 | Preparation Example 1 | 200 | 50 | 62 | 67 | 70 | 90 | 97.3 | 97.2 | 35 | 35 | 36 | 88 | 95.3 | 95.2 |
| Belt 21 | Preparation Example 2 | 200 | 50 | 61 | 67 | 70 | 89 | 97 | 97.2 | 34 | 35 | 36 | 87 | 95 | 95 |
| Belt 26 | Preparation Example 2 | 100 | 50 | 62 | 67 | 71 | 89 | 97 | 97.2 | 35 | 35 | 37 | 87 | 95 | 95 |
| Belt 31 | Preparation Example 2 | 200 | 80 | 63 | 68 | 71 | 88 | 97 | 96.5 | 35 | 36 | 37 | 88 | 94 | 95 |
| Belt 36 | Polyimide single layer | | >90 | 66 | 71 | 72 | 82 | 91 | 90 | 37 | 37 | 37 | 81 | 90 | 90 |
| Belt 14 | Preparation Example 1 | 200 | 50 | 62 | 67 | 70 | 84 | 96 | 97.2 | 35 | 35 | 36 | 82 | 94 | 95.2 |
| Belt 22 | Preparation Example 2 | 200 | 50 | 61 | 67 | 70 | 84 | 96 | 97 | 34 | 35 | 36 | 82 | 93 | 95 |
| Belt 27 | Preparation Example 2 | 100 | 50 | 62 | 67 | 71 | 83 | 95 | 97 | 35 | 35 | 37 | 82 | 93 | 94 |
| Belt 32 | Preparation Example 2 | 200 | 80 | 63 | 68 | 71 | 83 | 95 | 97 | 35 | 36 | 37 | 82 | 94 | 94 |
| Belt 37 | Polyimide single layer | | >90 | 65 | 70 | 72 | 78 | 90 | 92 | 37 | 37 | 37 | 78 | 89 | 89 |

FIG.16

| | Shape factor of toner | | | Normal temperature and normal humidity environment | | High temperature and high humidity environment | Low temperature and low humidity environment | Judgment |
|---|---|---|---|---|---|---|---|---|
| | | | | Initial state | After printing of 20,000 sheets | After printing of 10,000 sheets | After printing of 10,000 sheets | |
| | SF−1 | SF−2 | | Initial state | 20,000 sheets in total | 30,000 sheets in total | 40,000 sheets in total | |
| Belt 2 | 110 | 110 | Halftone | ○ | ○ | ○ | ○ | Excellent |
| | | | Color difference (⊿E) | 0 | 3 | 4 | 4 | Excellent |
| | | | Line width | 35 | 35 | 30 | 40 | Excellent |
| | | | Memory | ○ | ○ | ○ | ○ | Excellent |
| Belt 2 | 130 | 140 | Halftone | ○ | ○ | ○ | ○ | Excellent |
| | | | Color difference (⊿E) | 0 | 4 | 5 | 5 | Good |
| | | | Line width | 34 | 35 | 29 | 38 | Excellent |
| | | | Memory | ○ | ○ | ○ | △ | Moderate |
| Belt 2 | 140 | 150 | Halftone | ○ | ○ | ○ | ○ | Excellent |
| | | | Color difference (⊿E) | 0 | 5 | 6 | 6 | Moderate |
| | | | Line width | 33 | 34 | 29 | 37 | Excellent |
| | | | Memory | ○ | △ | △ | × | NG |
| Single-layered polyimide (related art) | 110 | 110 | Halftone | ○ | △ | × | × | NG |
| | | | Color difference (⊿E) | 0 | 5 | 6 | 6 | Moderate |
| | | | Line width | 69 | 71 | 69 | 85 | NG |
| | | | Memory | ○ | ○ | ○ | ○ | Excellent |
| Belt 33 | 110 | 110 | Halftone | ○ | △ | × | × | NG |
| | | | Color difference (⊿E) | 0 | 5 | 6 | 6 | Moderate |
| | | | Line width | 37 | 40 | 35 | 45 | Moderate |
| | | | Memory | ○ | ○ | ○ | ○ | Excellent |
| Belt 12 | 110 | 110 | Halftone | ○ | ○ | ○ | ○ | Excellent |
| | | | Color difference (⊿E) | 0 | 3 | 4 | 4 | Excellent |
| | | | Line width | 62 | 64 | 60 | 70 | NG |
| | | | Memory | ○ | ○ | ○ | ○ | Excellent |

| | Applied bias to charging roller | | Low temperature and low humidity environment |
|---|---|---|---|
| Belt 2 | DC500v+Acpp2kv | Number of sheets on which the memory could be confirmed in printing a memory chart on 20 sheets | 0 |
| | DC1100v | | 2 |
| Single-layered polyimide (related art) | DC500v+Acpp2kv | | 0 |
| | DC1100v | | 8 |

IMAGE FORMING APPARATUS AND IMAGE FORMING METHOD

BACKGROUND OF THE INVENTION

1. Field of the Invention

The present invention relates to an image forming apparatus using an intermediate transfer body and in particular, to a technology for improving a transfer performance of an intermediate transfer body.

2. Description of the Related Art

In a color image forming apparatus of an electro-photographic system, there is known a configuration in which by using an intermediate transfer belt, toner images of four colors are superimposed on the intermediate transfer belt and then transferred at once on paper or the like. This is concerned with a technology in which by applying the "superimposition and transfer" which is liable to become unstable from the process standpoint to a stable intermediate transfer belt, the toner images are transferred to the intermediate transfer belt while keeping high image quality and then transferred at once on a final transfer material such as paper. Thus, multiplicity of use of paper can be improved while controlling the degradation of image quality to the minimum. In recent years, in an image forming apparatus employing a so-called "tandem system", the foregoing intermediate transfer system has become the mainstream.

Also, in recent years, in such an image forming apparatus aiming to realize high image quality, a small-sized toner having an average particle size of not more than 6 μm is being widely used. Following this, in the development processing and transfer processing, realization of higher image quality and higher stabilization is being demanded.

In particular, a transfer step is a step which is frequently accompanied with a discharging phenomenon and which is largely related to the degradation of image quality. For example, in a primary transfer step, the transfer is achieved by the movement of a toner from a photoconductor to an intermediate transfer belt by an electric field formed between the intermediate transfer belt and the photoconductor. Actually, discharging is generated in a region close to and before a contact part between the photoconductor and the intermediate transfer belt, and a part of the toner flies on the intermediate transfer belt.

Since the foregoing discharging phenomenon locally occurs and is generated unstably and continuously, the toner attached onto the intermediate transfer belt is influenced by the discharging from various directions and moves towards a direction of a belt surface, whereby so-called "transfer scattering" is possibly generated. Furthermore, a part of the toner which has moved from the photoconductor to the intermediate transfer belt in a transfer nip section also receives a local force in various directions by the discharging phenomenon and moves in a lateral direction in a region where the photoconductor and the intermediate transfer belt are separated from each other, whereby transfer scattering is generated. The generation of such transfer scattering leads to the degradation of an image in the image forming apparatus.

Also, in a secondary transfer step from the intermediate transfer belt to a body to be transferred such as paper, when discharging is generated before the belt and the body to be transferred come into contact with each, the toner on the intermediate transfer belt moves towards a direction of the belt surface likewise the primary transfer, whereby transfer scattering is generated, too. At that time, since an electrostatic latent image is not present on the intermediate transfer belt, a force to electrostatically fix the position of a toner does not substantially work, whereby the toner becomes in a state that it is liable to move (scatter) towards the direction of the belt surface.

As described above, the image scattering in the transfer step was generated not a little due to the discharging phenomenon generated before and after the transition position in the primary transfer step and secondary transfer step. In addition, the foregoing transfer scattering is more likely influenced in a spherical toner in which an adhesive force of the toner to the intermediate transfer belt becomes easily weak. In particular, this was problematic in the case of using a small-sized spherical toner. Moreover, at the transfer position, when a portion containing a toner and a portion not containing a toner are present, especially when the toner is present in two or more layers, in the case of a toner having a particle size of 5 μm, a thickness difference becomes possibly 8 μm or more. As is clear from the Paschen's law of discharging, the discharging in air is generated from a gap of approximately 6 μm. Accordingly, in a portion of a difference in level by the toner of two or more layers, the discharging is generated in the inside of the transfer nip, too, whereby the degradation of image quality is generated.

Also, since a difference in pressure is also generated in the transfer nip between a region where a toner thickness is present and a region where a toner image is not present, when a line having a thickness to some extent is transferred, "hollow defects" that the center of the subject line turns back to a side of the photoconductor without being transferred are generated, too.

SUMMARY OF THE INVENTION

Embodiments of the invention are aimed to provide a technology capable of suppressing the generation of transfer scattering of a toner image on an intermediate transfer body and contributing to an improvement in image quality in an image forming apparatus employing an intermediate transfer system.

In order to solve the foregoing problems, an image forming apparatus according to an embodiment of the invention is configured to include an intermediate transfer belt to which a toner imager is transferred from an image carrier, the intermediate transfer belt having an elastic surface layer having a center point average roughness of 0.1 times or more of a volume average particle size of a used toner and a ten-point average roughness of not more than the volume average particle size of the used toner; and a development section which develops an electrostatic latent image on the image carrier by using a toner having a shape factor SF-1 in the range of from 100 to 130 and a shape factor SF-2 in the range of from 100 to 140.

Also, an image forming apparatus according to an embodiment of the invention is configured to include an intermediate transfer belt which transfers a toner imager transferred from an image carrier to a sheet at a prescribed transfer position, the intermediate transfer belt having an elastic surface layer having a center point average roughness of 0.1 times or more of a volume average particle size of a used toner and a ten-point average roughness of not more than 3 times of the volume average particle size of the used toner; a development section which develops an electrostatic latent image on the image carrier by using a toner having a shape factor SF-1 in the range of from 100 to 130 and a shape factor SF-2 in the range of from 100 to 140; and a vibration imparting section which imparts vibration to the toner carried on the intermediate transfer belt in the vicinity of the prescribed transfer position.

Also, an image forming method according to an embodiment of the invention is configured to include developing an electrostatic latent image on an image carrier by using a toner having a shape factor SF-1 in the range of from 100 to 130 and a shape factor SF-2 in the range of from 100 to 140; and transferring a toner image formed on the image carrier to an intermediate transfer body having an elastic surface layer having a center point average roughness of 0.1 times or more of a volume average particle size of the used toner and a ten-point average roughness of not more than the volume average particle size of the used toner.

DESCRIPTION OF THE DRAWINGS

FIG. 10 is a table to show the results obtained by comparing the case where a surface layer is prepared by coating a rubber layer and then polishing it; the case where a surface layer is prepared by changing a thickness of an elastic layer; and the case where a surface layer is prepared by further changing a hardness of the elastic surface layer.

FIG. 11 is a table to show the results obtained by comparing the case where a surface layer is prepared by coating a rubber layer and then polishing it; the case where a surface layer is prepared by changing a thickness of an elastic layer; and the case where a surface layer is prepared by further changing a hardness of the elastic surface layer.

FIG. 16 is a table to show the results of a continuous printing test in the case where the present embodiment is applied.

DESCRIPTION OF THE EMBODIMENTS

Embodiments of the invention are hereunder described with reference to the accompanying drawings.

First Embodiment

First of all, a first embodiment of the invention is described.

Figure 1:
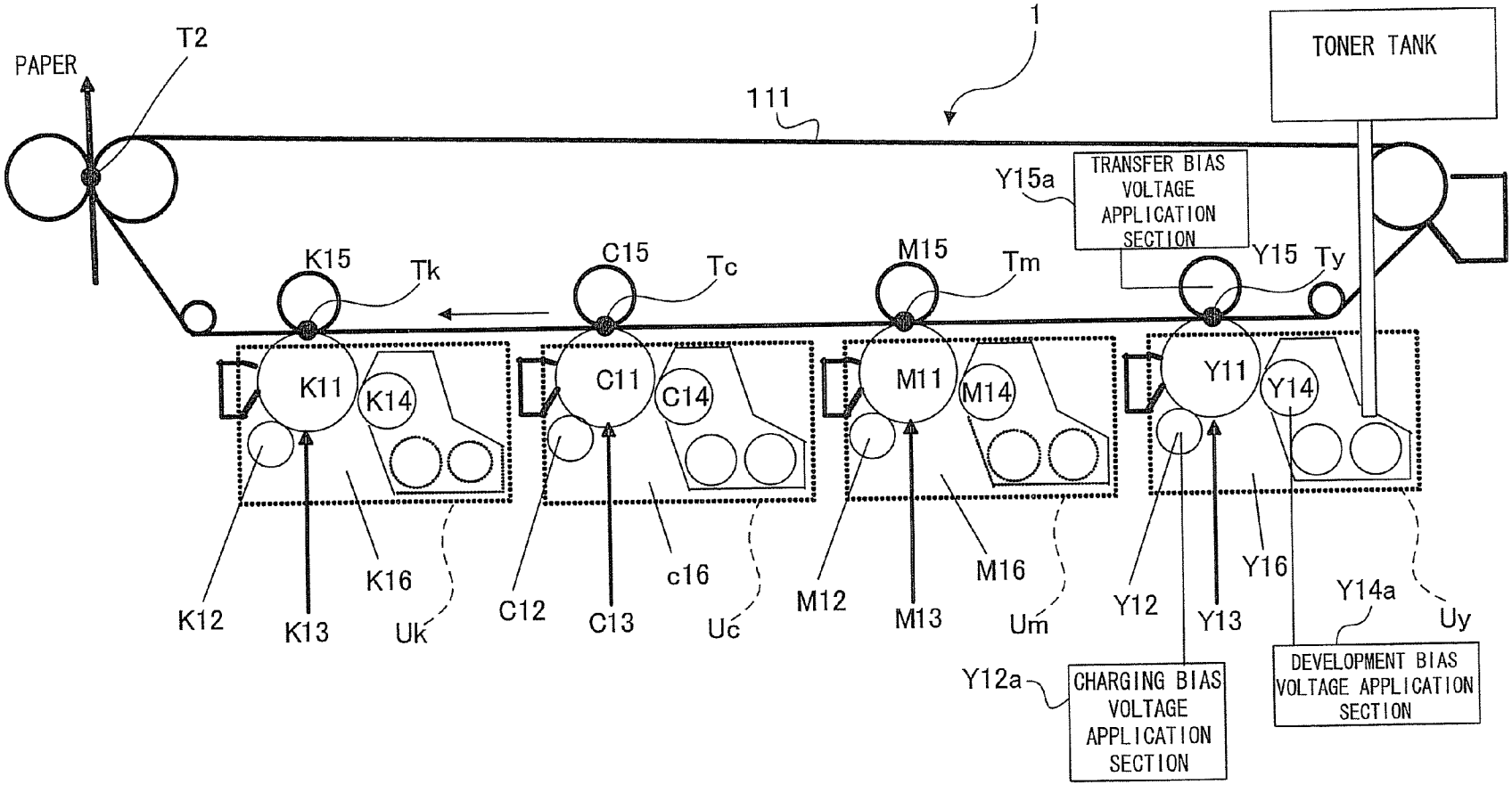
FIG. 1 is a view to show a configuration of a color image forming apparatus using an intermediate transfer belt according to a first embodiment of the invention.

FIG. 1 is a view to show a configuration of a color image forming apparatus using an intermediate transfer belt according to the first embodiment of the invention.

As illustrated in FIG. 1, an image forming apparatus 1 according to the present embodiment has a configuration of a so-called quadruple tandem type employing an intermediate transfer system.

Concretely, the image forming apparatus 1 is provided with an intermediate transfer belt 111, process units Uk, Uc, Um and Uy and a transfer roller 15.

The intermediate transfer belt 111 (corresponding to an intermediate transfer body or an intermediate transfer unit) is an intermediate transfer belt to which a toner image is transferred from a photoconductor (image carrier) in each of the process units and has an elastic surface layer having a center point average roughness of 0.1 times or more of a volume average particle size of a toner used in the image forming apparatus 1 (the toner will be hereinafter referred to as "used toner") and a ten-point average roughness of not more than the volume average particle size of the used toner.

Furthermore, the transfer roller 15 (Y15, M15, C15 and K15) has a role to transfer a toner image on a photoconductor 11 to the intermediate transfer belt 111.

The process unit Uy is provided with a photoconductor Y11; a charging member Y12 (corresponding to a charging unit) to which a prescribed charging bias voltage is applied by a charging bias voltage application section Y12*a* and which charges a photoconductive surface of the photoconductor Y11; and a development unit Y14 to which a prescribed development bias voltage is applied by a development bias voltage application section Y14*a* and which develops an electrostatic latent image formed on the photoconductor Y11 by an exposure section Y13 by a toner. Incidentally, since each of the process units Uk, Uc and Um has the same configuration as in the foregoing process unit Uy, their explanations are omitted.

Incidentally, in the development units K14, C14, M14 and Y14 (corresponding to a development section or a development unit) in each of process units Uk, Uc, Um and Uy, the electrostatic latent image on the photoconductor 111 is developed by using a toner having a shape factor SF-1 in the range of from 100 to 130 and a shape factor SF-2 in the range of from 100 to 140.

Incidentally, in each of the process units Uk, Uc, Um and Uy in the present embodiment, the photoconductor and at least one of the charging member and the development unit are integrally supported as the process unit, which is made attachable to or detachable from the main body of the image forming apparatus 1.

As illustrated in FIG. 1, in the present embodiment, as one example, each of the process units is provided with the photoconductor, the charging member and the development unit. As a matter of course, the process unit U can also be configured to include other portions than those as described above in response to a space restriction in the image forming apparatus or the arrangement of parts or the like.

Furthermore, known materials such as OPC (organic photo-conductor) and amorphous silicon (a-Si) are employable for the photoconductor in each of the process units. For the charging member, for example, a scorotron charger, a charging roller, and the like can be used. For example, in the case of using a charging roller, an AC bias of pp2 kV (2 kHz) can be applied to DC −650 V, thereby charging the photoconductor at −650 V. In the exposure section, a laser, LED, and the like can be used. For example, in the exposure section, a semiconductor laser having a wavelength of 700 nm is used, and a surface potential in an exposed portion of the photoconductor is lowered to approximately 0 to −300 V. At that time, it is preferable that the exposure amount is set up at from approximately a half decay exposure amount of the photoconductor to approximately four times thereof.

As the development system in each of the process units, various systems such as a two-component development system made of a toner and a carrier and a one-component development system made of only a toner without using a carrier are employable. For example, in the two-component development system, the development is carried out by forming napping on a magnetic roller having a permanent magnet contained therein by the carrier and applying a DC bias or a (DC+AC) bias between the magnetic roller and the surface of the photoconductor. Examples of a development bias voltage include one by superimposing AC pp2 kV (6 kHz) on DC −500 V. In particular, as to the AC bias, there are made various devices for realizing high image quality such as employment of a square wave and changing of a duty ratio.

In the foregoing image forming apparatus, for example, when the exposure amount is approximately 1.3 times of a half decay exposure amount of the photoconductor, a potential of the photoconductor after the exposure is approximately −250 V, and a difference between a potential in a non-image part of the photoconductor and a development bias (background contrast) is 150 V. Here, a difference between the development bias and the potential after the exposure (development contrast) is 250 V.

Subsequently, the toner image which has been developed on the photoconductor under such a condition is transferred onto the intermediate transfer belt 11 at the transfer position (see Tk, Tc, Tm and Ty in FIG. 1). The intermediate transfer belt 11 has semi-conductivity and is configured of a resin or a rubber or a stack member thereof having a thickness of from 50 to 3,000 μm, and the transfer roller (transfer unit) comes into contact with a backside of the belt opposing to a side of the photoconductor. A prescribed transfer bias voltage is applied to the transfer roller by a transfer bias voltage application section Y15*a*, and a transfer electric field is applied in a transfer nip section where the photoconductor and the intermediate transfer belt 11 come into contact with each other or in the surroundings thereof.

In the present embodiment, the transfer rollers K15, C15, M15 and Y15 using a semiconductive sponge having a volume resistivity of from 10e5 to 10e9 Ω·cm are each brought into contact with a back surface of the belt; and DC of from 300 V to 3,000 V is applied, thereby transferring a toner image on the photoconductor of each of the process units onto the intermediate transfer belt 111. Then, by arranging these four process units in a line and performing superimposition and transfer, a full-color image is formed and then transferred onto paper at a secondary transfer position T2; and the image is thermally fixed by a non-illustrated fixing unit, thereby forming a final image.

In such a configuration, a single intermediate transfer body is present; and two steps of a primary transfer step for transferring a toner image onto the intermediate transfer belt from the photoconductor and a secondary transfer step for superimposing toner images of four colors by the primary transfer step and then transferring them at once onto paper or the like are present. As a matter of course, the configuration of the image forming apparatus may be a printing system in which the toner image is introduced into a recording medium via plural intermediate transfer bodies, and the invention is not particularly limited, except for using an intermediate transfer body. Furthermore, in each of the process units, a cleaning member (cleaning unit) for removing the toner remaining on the photoconductor after the primary transfer step is provided in a usual process, and if desired, an antistatic treatment is further carried out. The photoconductor again goes to the charging step.

Figure 2:
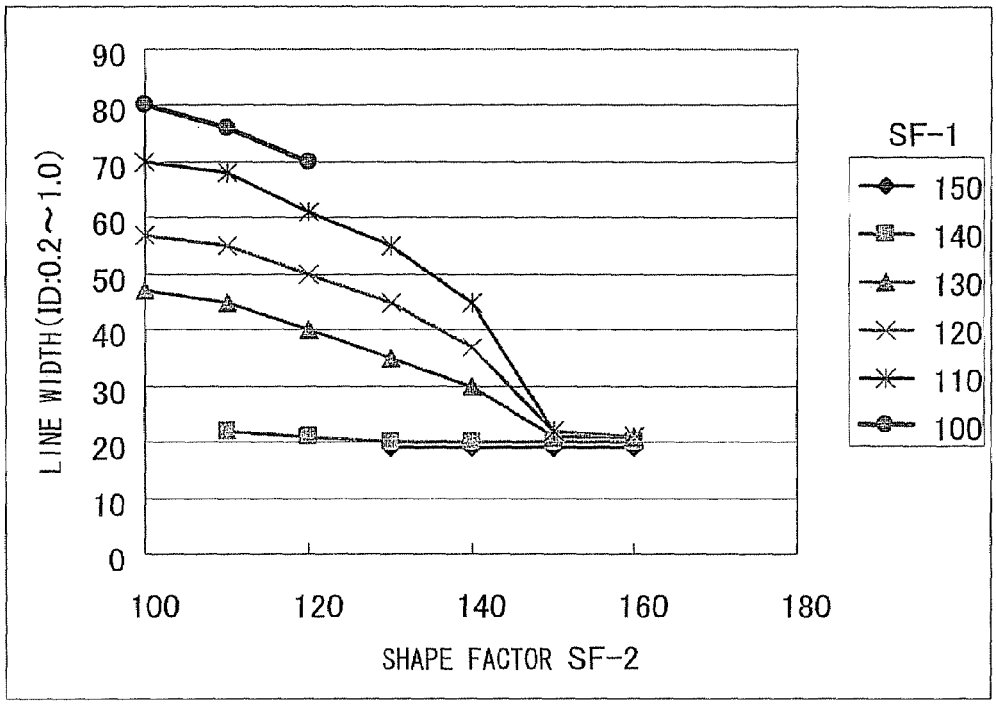
FIG. 2 is a graph to show the results of comparison of a shape factor of a toner and a generation state of scattering of a toner in a transfer step.

FIG. 2 is a graph to show the results of comparison of a shape factor of a toner and a generation state of scattering of a toner in a transfer step.

In the present embodiment, a resin belt of a single-layered structure was used as the intermediate transfer belt 111. Concretely, a polyimide-made belt having a thickness of 125 μm was used as the intermediate transfer belt 111. As the intermediate transfer belt in the present embodiment, ones having a volume resistivity of from 10e7 to 10e12 Ω·cm are employable. However, one having a volume resistivity of approximately 10e9 Ω·cm was used herein. The resistivity of the belt was measured by using HIRESTA, manufactured by Mitsubishi Petrochemical Co., Ltd. under a condition of an HRSS probe and an applied voltage of 250 V.

Furthermore, the toner used in each of the process units was prepared by a pulverization preparation method using a polyester as a major component, and its shape factor was adjusted by a thermal treatment (therfusion treatment) after preparing a toner particle by a pulverization method. Moreover, a particle size of the toner was unified into approximately 6 μm and evaluated. With respect to the particle size of the toner, the range of from 0.1 to 200 μm was divided into 32 parts and measured by using a laser diffraction, scattering, particle size distribution analyzer (LA-950, manufactured by Horiba, Ltd.), and an average particle size of 50% of the volume distribution was defined as an average particle size.

Figure 3:
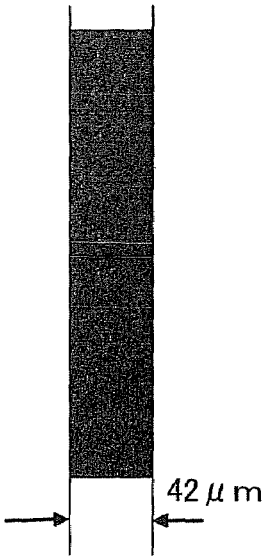
FIG. 3 is an outline view to explain details of transfer scattering.
Figure 4:
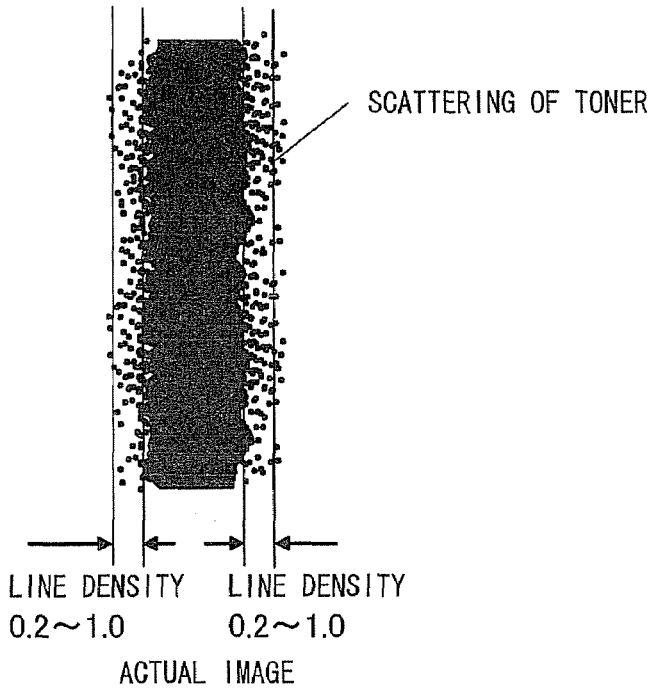
FIG. 4 is an outline view to explain details of transfer scattering.

The scattering was evaluated in the following manner. First of all, a line image of 1 dot line of 600 dpi was prepared on a photoconductor and transferred onto an intermediate transfer body. The image was transferred onto paper by secondary transfer, and a line width was measured. As the paper, Neusiedler paper for color copiers with high smoothness was used. For the measurement, an image evaluation analyzer DA-6000 was used, and a width of a portion having an image density (ID) of from 0.2 to 1.0 was measured with respect to the evaluation of scattering. FIGS. 3 and 4 are each an outline view to explain details of transfer scattering. As illustrated in FIG. 3, a line width state is ideally a state that not only the image density is 1.0 or more and the width of 42 μm, but also a region having a width of from 0.2 to 1.0 (region of transfer scattering) as illustrated in FIG. 4 is zero. However, in the photoconductor, the relationship as illustrated in FIG. 3 is not actually established, and the width having an image density of from 0.2 to 1.0 is spread due to the scattering in the transfer step. With respect to the measured value, an average value in subject areas (areas of transfer scattering) in both left and right sides of the line in FIG. 4 was employed.

With respect to SF-1 and SF-2 which are each a shape factor of the toner, 100 toner images of 1 μm or more as enlarged 1,000 times by using FE-SEM (S-800), manufactured by Hitachi, Ltd. were randomly sampled; image information thereof was captured on an image analyzer (Luzex AP), manufactured by Nireco Corporation; and SF-1 and SF-2 were respectively computed according to the following expressions (1) and (2).

$$SF\text{-}1=((MXLNG)2/(\text{AREA}))\times(\pi/4)\times 100 \quad (1)$$

$$SF\text{-}2=((PERIME)2/(\text{AREA}))\times(1/4\pi)\times 100 \quad (2)$$

In the expressions (1) and (2), MXLNG represents an absolute maximum length of the particle; PERIME represents a peripheral length of the particle; and AREA represents a projected area of the particle.

The shape factor SF-1 represents a degree of roundness of the toner particle; and the shape factor SF-2 represents a degree of irregularities of the toner particle. In the both shape factors, it is meant that when the value is closer to 100, the shape becomes closer to a true sphere.

According to FIG. 2, it is understood that the width having an image density of from 0.2 to 1.0 begins to increase from a region where SF-1 is not more than 130 and SF-2 is not mote than 140. That is, it is understood that in a region where the shape factors exceed the foregoing values, the scattering is not substantially generated at the time of transfer, and the toner particle is stable; whereas when the sphericity of the toner particle exceeds the prescribed value, the transfer scattering increases.

As described above, it is understood that when a spherical toner is used, the scattering at the time of transfer becomes problematic.

Then, in the present embodiment, the intermediate transfer belt is configured in the following manner.

That is, a surface of the intermediate transfer belt was formed into an elastic surface layer, and a surface roughness of the elastic surface layer was set up at a prescribed value.

Concretely, the surface roughness of the intermediate transfer belt 111 is set up so as to have a center point average roughness Ra in the range of from 0.1 to 0.5 times of a volume average particle size of the used toner and a ten-point average roughness Rz of not more than the volume average particle size of the used toner.

The surface roughness was measured by using a laser microscope LM-21, manufactured by Lasertec Corporation. This is because the surface roughness cannot be precisely measured by a contact manner because the surface is an elastic layer. With respect to the measurement of the roughness, 10 places of a region of approximately 20 μm×20 μm were extracted and measured, respectively, and an average value in eight places exclusive of those having a maximum value and a minimum value was employed.

The center point average roughness Ra is a value in terms of micrometer (μm), which is obtained by folding a roughness curve from a center line and dividing an area obtained by the roughness curve and the center line by a length L.

Furthermore, the ten-point average roughness Rz is a value in terms of micrometer (μm), which is a difference between an average value in height of from the maximum top to the fifth top and an average value in height of from the deepest bottom to the fifth bottom in a portion resulting from taking out a standard length from a sectional curve.

When the center point average roughness Ra is too small, a force to prevent the movement of the toner on the intermediate transfer belt towards a lateral direction is insufficient so that it is difficult to suppress the movement of scattering in a direction of the belt surface. On the other hand, when the center point average roughness Ra is too large, the toner falls into irregularities of the surface of the intermediate transfer belt so that the transfer characteristics (efficiency) are possibly deteriorated. Furthermore, when the ten-point surface roughness Rz is too large, the toner also falls into irregularities of the surface of the intermediate transfer belt so that the transfer characteristics (efficiency) are deteriorated.

<Preparation of Intermediate Transfer Belt>

As a substrate layer of the intermediate transfer belt, polyimides, polycarbonates, and the like can be used.

As a material of the elastic surface layer, urethane rubbers, silicone rubbers, acrylic rubbers, NBR (nitrile rubber), and the like can be used. Such a material may be adhered in a thickness of not more than 2 mm onto the substrate layer by properly utilizing centrifugal molding, extrusion molding, shape molding, or the like, or may be coated on the substrate layer by spray coating by using a sprayer or the like. With respect to such preparation, known general preparation methods can be employed.

Furthermore, with respect to a method of imparting a surface roughness to the elastic layer, a method of imparting a fixed surface roughness by polishing the surface of the prepared intermediate transfer belt is the simplest method. For example, the intermediate transfer belt is set in a cylinder and rotated at a high revolution, and a file of from approximately #300 to #2000 is brought into contact therewith. By repeating this operation several times while properly changing a direction of setting the belt in the cylinder, it is possible to make the surface of the intermediate transfer belt have a desired surface roughness.

Furthermore, with respect to a method of forming the elastic surface layer into an expanded elastic layer, for example, it is possible to prepare an elastic surface layer having minute expanded cells by employing a supercritical method. Concretely, the foregoing expanded elastic layer is obtained by introducing a supercritical fluid or a subcritical fluid into a liquid rubber and expanding the liquid rubber by the action of the foregoing supercritical fluid or subcritical fluid. Examples of the supercritical fluid or subcritical fluid include carbon dioxide, nitrogen, ethane and ethylene, all of which are in a supercritical state or subcritical state.

In the case where a raw material rubber is classified with respect to a shape at room temperature (from 15 to 30° C.), the "liquid rubber" as referred to herein means a rubber which is liquid and has fluidity. Examples thereof include liquid urethane rubber, liquid silicone rubber, liquid isobutylene rubber, liquid isoprene rubber, liquid polybutadiene rubber, liquid polyalkylene oxides, and hydrogenated isoprene. These materials are used singly or in combination of two or more kinds thereof.

The "liquid urethane rubber" as referred to herein means a raw material rubber which is liquid and can be crosslinked by molding. The liquid silicone rubber contains, as a major component, a diorgano polysiloxane having a degree of polymerization of from 1,000 to 200,000 and is classified into dimethyl silicone, methyl vinyl silicone, methyl phenyl silicone, fluoro silicone, and so on depending upon the kind of a side chain thereof.

An average molecular weight (Mn) of such a liquid rubber is preferably in the range of from 1,000 to 200,000, and especially preferably in the range of from 2,000 to 50,000. In order to crosslink the liquid rubber, in addition to the liquid rubber, a crosslinking agent (hardening agent), a catalyst, a vulcanization promoter, a vulcanization auxiliary, an expanding agent, an expansion auxiliary, and the like are used as the need arises. Details thereof are disclosed in the citations. Furthermore, a conductive agent or the like may be blended for the purpose of imparting conductivity. Examples of the conductive agent include carbon black (for example, acetylene black), graphite, potassium titanate, iron oxide, conductive titanium oxide, conductive zinc oxide, conductive indium oxide, and ion conductive agents (for example, quaternary ammonium salts, boric acid salts, and surfactants). These materials can be used singly or in combination of two or more kinds thereof. Examples of the conductive agent which is not described in the citations include carbon nanotubes and fullerenes.

The fullerene has an effect for improving wear resistance and is able to improve the durability of an elastic body itself upon addition of a proper amount thereof. Furthermore, in the carbon nanotube, high conductivity can be obtained upon addition of a smaller amount thereof than that of usual carbon black, and therefore, a degree of freedom by which the resistance can be adjusted is spread. As the carbon nanotube, known materials can be used, and those having a diameter of from 1 nm to 500 nm and a length of from 10 nm to 500 μm can be used. With respect to the fullerene, those having a particle size of from 1 nm to 1 μm can be used.

The elastic expanded body in the present embodiment can be, for example, prepared by using the foregoing respective materials in the following manner. That is, first of all, the foregoing liquid rubber, a crosslinking agent (hardening agent) and a conductive agent and optionally, a carbon nanotube or a fullerene are blended to prepare an expanded body material (in a liquid state), which is then kept within a high-pressure chamber. Subsequently, a supercritical fluid or subcritical fluid such as carbon dioxide in a supercritical fluid or subcritical state is brought into contact with the expanded body material kept within the high-pressure chamber, thereby penetrating and dissolving the supercritical fluid or subcritical fluid in the liquid rubber to achieve impregnation. Next, the pressure within the foregoing high-pressure chamber is reduced to a prescribed range to release the supercritical fluid or subcritical fluid impregnated in the liquid rubber, thereby expanding the rubber due to that action.

Then, the expanded rubber is taken out from the high-pressure chamber, molded and vulcanized under a usual vulcanization condition (for example, 150° C.×30 minutes). Thus, a desired elastic expanded body can be obtained. In the case where the liquid rubber is expanded in this way, the liquid rubber has softness as compared with a solid rubber, and therefore, there is an advantage that cells are easily uniformly distributed and formed. Furthermore, in comparison with a solid rubber, the pressure for molding or the like can be minimized, the permanent set caused on a basis on pressurization can be minimized, and an elastic expanded body with high precision can be obtained.

Incidentally, in the invention, the crosslinking may be carried out simultaneously with the expansion due to the release of the supercritical fluid or subcritical fluid.

PREPARATION EXAMPLE 1

$CO_2$ was impregnated in 100 parts by weight (hereinafter abbreviated as "parts") of polypropylene glycol (PPG) polyol (manufactured by Nippon Polyurethane Industry Co., Ltd., OH value: 131 mg-KOH/g, viscosity: 790 mPa·s/25° C.), from 5 to 15 parts of carbon black (DENKA BLACK HS100, manufactured by Denki Kagaku Kogyo K.K.) and a carbon nanotube and 40 parts of an isocyanate (COLONATE 1407, manufactured by Nippon Polyurethane Industry Co., Ltd.) within an RIM (reaction injection molding) machine under a condition of 10 MPa×50° C.; after mixing, the pressure (0.5 to 5 MPa), the temperature (100 to 150° C.) and the time (10 to 50 minutes) were controlled; and the crosslinking temperature (100 to 200° C.) and the time (15 to 50 minutes) were further controlled, thereby preparing an elastic expanded body. Thereafter, the elastic expanded body was molded in a thickness of 200 μm on a polyimide-made belt having a thickness of 80 μm, thereby obtaining an expanded elastic belt of the present embodiment.

PREPARATION EXAMPLE 2

A polyimide-made intermediate transfer belt having a thickness of 80 μm was set in a cylinder; a silicone rubber layer was spray coated thereon; and thereafter, the silicone rubber layer was polished while rotating the cylinder, thereby adjusting the thickness of the elastic layer at 200 μm. On that occasion, the roughness of the elastic layer was adjusted by changing a polishing condition.

The following intermediate transfer belts were prepared in the same manner as in the foregoing Preparation Example 1 or Preparation Example 2. A hardness of a single body of the elastic surface layer was regulated at approximately 500° in terms of Asker-C.

| | Center point average roughness Ra (μm) | Ten-point average roughness Rz (μm) |
|---|---|---|
| Belt 1 (Preparation Example 1) | 0.5 | 4.6 |
| Belt 2 (Preparation Example 1) | 0.7 | 4.8 |
| Belt 3 (Preparation Example 1) | 0.9 | 4.7 |
| Belt 4 (Preparation Example 1) | 1.2 | 4.5 |
| Belt 5 (Preparation Example 1) | 2.0 | 4.8 |
| Belt 6 (Preparation Example 1) | 2.9 | 5.1 |
| Belt 7 (Preparation Example 1) | 3.9 | 7.0 |
| Belt 8 (Preparation Example 1) | 0.3 | 1.1 |
| Belt 9 (Preparation Example 1) | 0.5 | 2.0 |
| Belt 10 (Preparation Example 1) | 0.5 | 3.1 |
| Belt 11 (Preparation Example 1) | 0.5 | 4.0 |
| Belt 12 (Preparation Example 1) | 0.5 | 5.0 |
| Belt 13 (Preparation Example 1) | 0.5 | 6.0 |
| Belt 14 (Preparation Example 1) | 0.5 | 7.0 |
| Belt 15 (Preparation Example 1) | 0.5 | 8.1 |
| Belt 16 (Preparation Example 1) | 0.6 | 9.0 |
| Belt 17 (Preparation Example 1) | 0.6 | 10.1 |
| Belt 18 (Preparation Example 2) | 0.7 | 4.8 (substantially the same as Belt 2) |
| Belt 19 (Preparation Example 2) | 0.9 | 4.8 (substantially the same as Belt 3) |
| Belt 20 (Preparation Example 2) | 0.5 | 5.0 (substantially the same as Belt 12) |
| Belt 21 (Preparation Example 2) | 0.5 | 6.0 (substantially the same as Belt 13) |
| Belt 22 (Preparation Example 2) | 0.5 | 7.0 (substantially the same as Belt 14) |

Furthermore, intermediate transfer belts having a thickness of the elastic surface layer of 100 μm were manufactured by way of trial in the same manners as in Belts 18 to 22 and designated as Belts 23 to 27, respectively. In addition, intermediate transfer belts (Belts 28 to 32) were prepared in the same manners as in Belts 18 to 22, except for changing the hardness of the elastic surface layer to 80° (partially including Belts 38 and 39 in which the hardness was changed to 10°). Moreover, for comparison, intermediate transfer belts (Belts 33 to 37) having a roughness substantially the same as in Belts 18 to 22 were also manufactured by way of trial by polishing a single-layered polyimide belt in a state not having elasticity.

Figure 5:
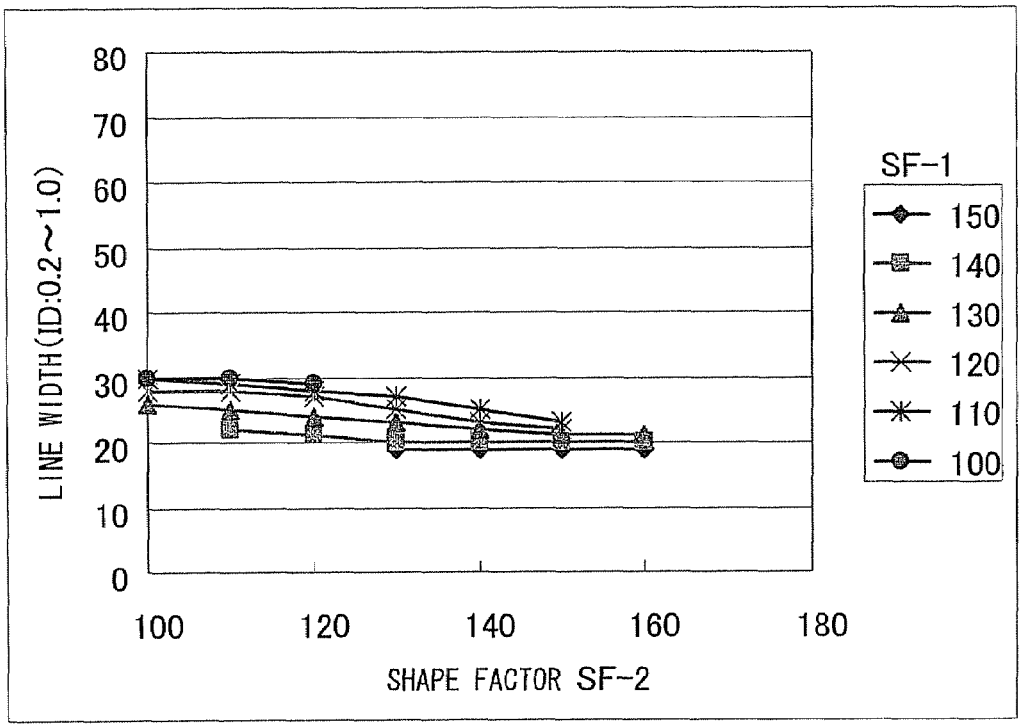
FIG. 5 is a graph to show the evaluation results obtained by using an intermediate transfer belt of Belt 4 when the same toner as in FIG. 2 is used.

FIG. 5 is a graph to show the evaluation results obtained by using an intermediate transfer belt of Belt 4 when the same toner as in FIG. 2 is used. According to this, it is understood that in comparison with the results (FIG. 2) of an intermediate transfer belt to which the invention is not applied, the transfer scattering is largely suppressed; and that even when the sphericity is increased, the region due to so-called scattering in a reflection density of from 0.2 to 1.0 is controlled to the same degree as in the case where the sphericity is low.

Figure 6:
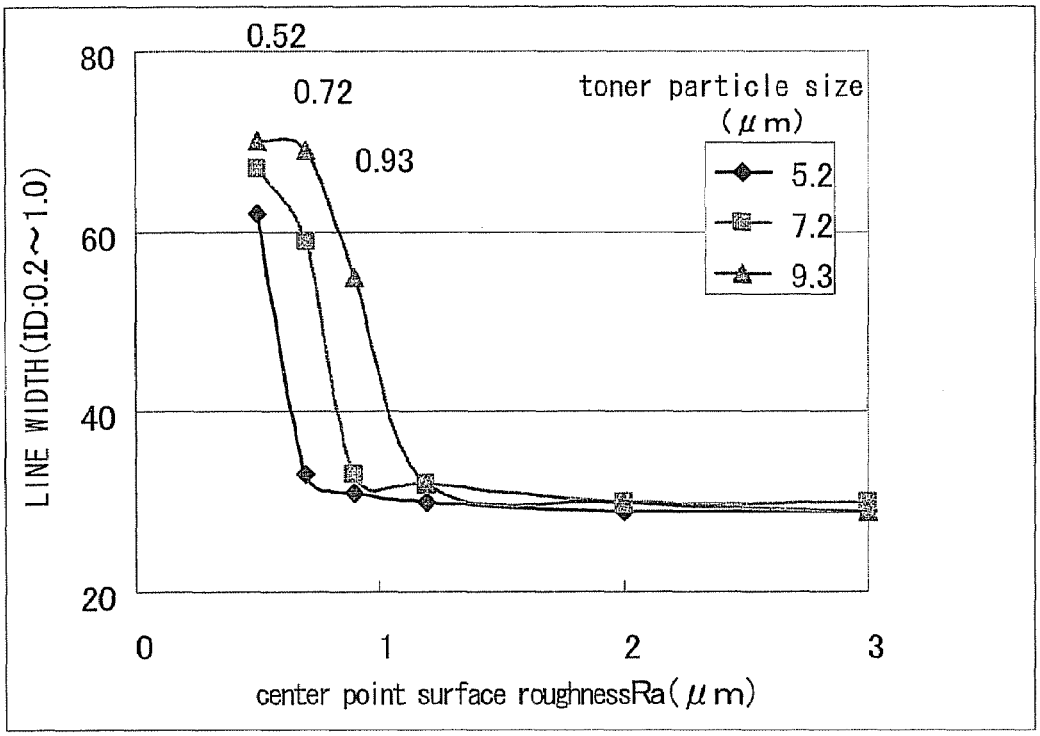
FIG. 6 is a graph to show the results of evaluation obtained by changing a center point average roughness Ra of an elastic surface layer of an intermediate transfer belt.

FIG. 6 is a graph to show the results of evaluation obtained by changing a center point average roughness Ra of an elastic surface layer of an intermediate transfer belt. FIG. 6 shows the evaluation results obtained by changing the average particle size in toners having a high sphericity in which since Belts 1 to 6 are used, the ten-point average roughness Rz is substantially fixed at approximately not more than 5 μm and the toner has shape factors SF-1 and SF-2 of 110 and 110, respectively. According to this, it is understood that in the case where the center point average roughness Ra of the elastic surface layer of the intermediate transfer belt is approximately 1/10 (0.1 times) or more of the average particle size of the toner, an effect for improving the scattering is observed.

Figure 7:
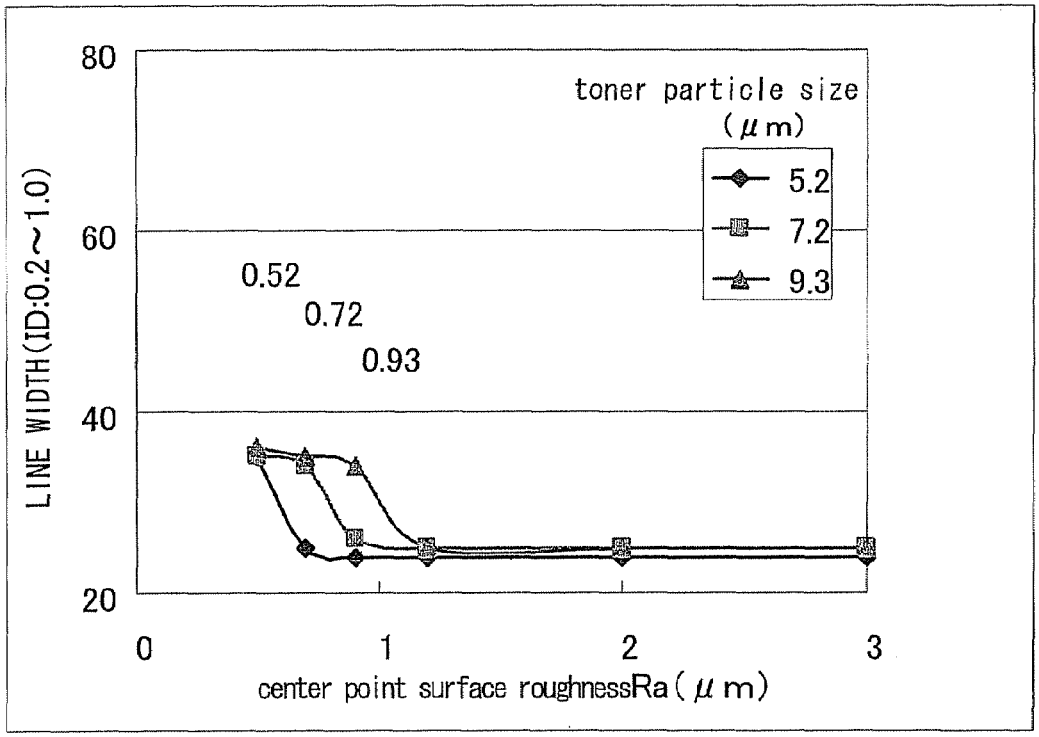
FIG. 7 is a graph to show the results of the same evaluation obtained by using a toner having a relatively low sphericity such that it has shape factors SF-1 and SF-2 of 130 and 130, respectively.

Furthermore, FIG. 7 is a graph to show the results of the same evaluation obtained by using a toner having a relatively low sphericity such that it has shape factors SF-1 and SF-2 of 130 and 130, respectively. On review of this, the original scattering level is small as compared with the case in FIG. 6 because of low sphericity. However, it is understood that in the case where the center point average roughness Ra of the elastic layer of the intermediate transfer belt is approximately 1/10 (0.1 times) or more of the average particle size of the toner, an effect for improving the scattering is observed, too.

Figure 8:
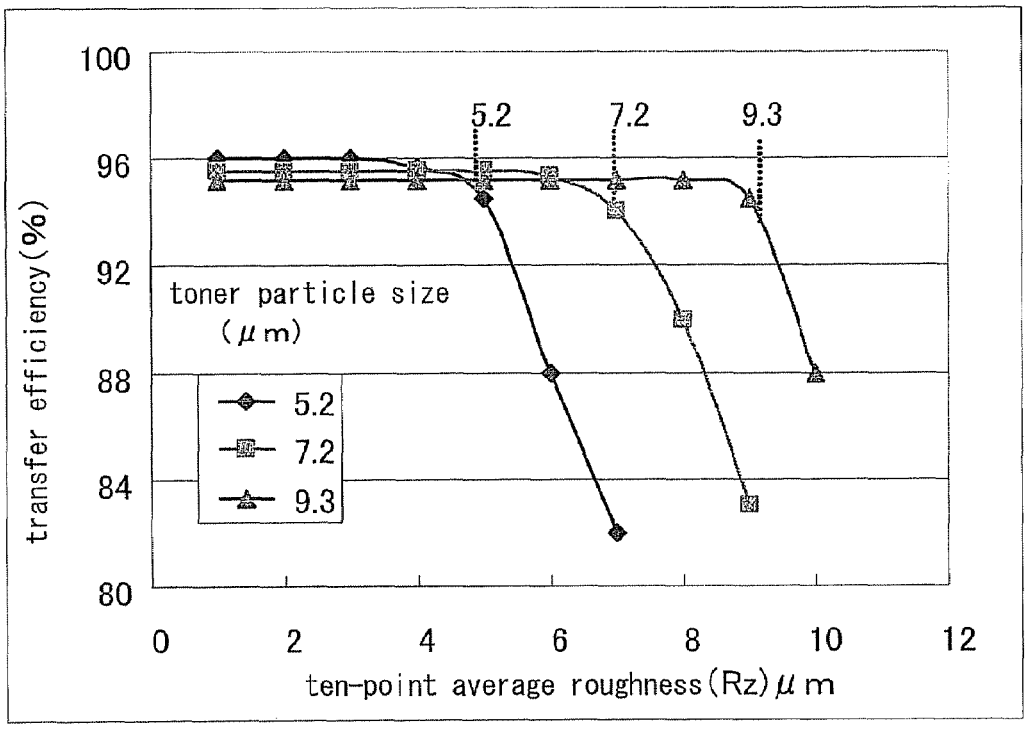
FIG. 8 is a graph to show the results obtained by measuring a transfer efficiency of secondary transfer characteristics by using Belts 8 to 17.

Next, FIG. 8 is a graph to show the results obtained by measuring a transfer efficiency of secondary transfer characteristics by using Belts 8 to 17. The transfer efficiency was determined from a ratio between a weight per unit area of the intermediate transfer belt obtained by sucking the toner prior to the secondary transfer and a weight per unit area obtained by sucking the residual transferred toner remaining on the intermediate transfer belt after the transfer. For sucking of the toner on the intermediate transfer belt, a Trek's suction type charging amount analyzer was used. In particular, since the amount of the residual transferred toner was a trace amount, the weight was measured by collecting over 60×250 mm. The transfer efficiency is expressed by [1−(amount of residual transferred toner)/(amount of toner prior to transfer)].

The results as shown in FIG. 8 are the evaluation results obtained by changing the average particle size in a toner having a high sphericity such that it has shape factors SF-1 and SF-2 of 110 and 110, respectively. According to this, it is understood that when the ten-point average roughness Rz of the elastic layer of the intermediate transfer belt is approximately the average particle size of the toner or more, the transfer efficiency is abruptly deteriorated.

Figure 9:
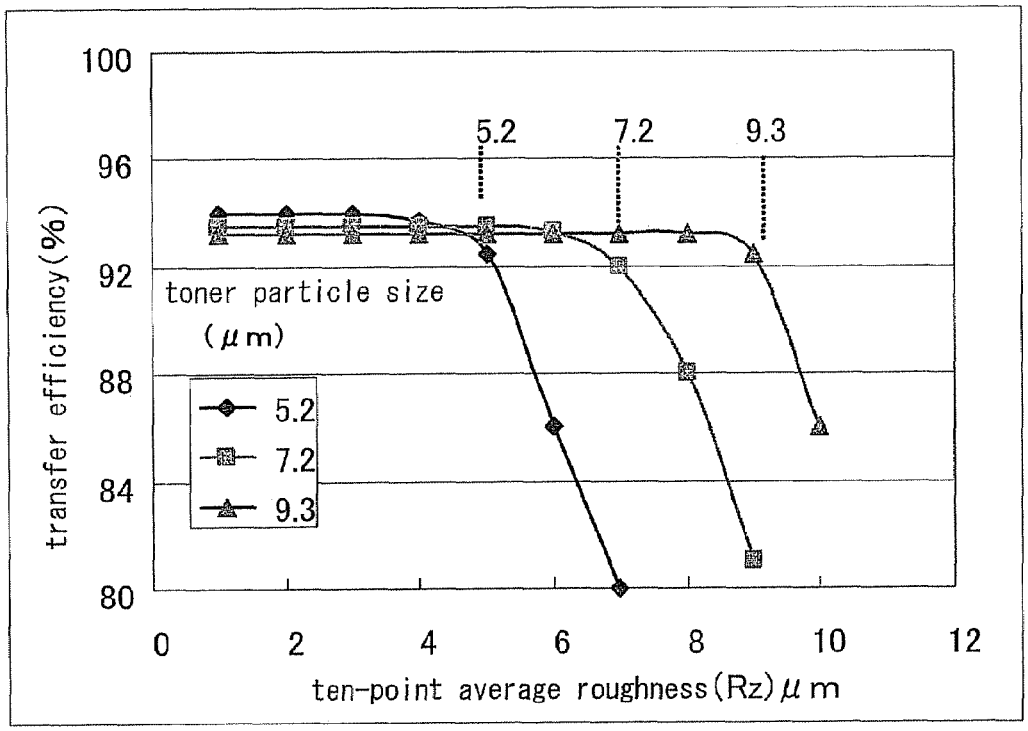
FIG. 9 is a graph to show the results of the same evaluation obtained by using a toner having a relatively low sphericity such that it has shape factors SF-1 and SF-2 of 130 and 130, respectively.

Furthermore, FIG. 9 is a graph to show the results of the same evaluation obtained by using a toner having a relatively low sphericity such that it has shape factors SF-1 and SF-2 of 130 and 130, respectively. According to this, it is understood that when the ten-point average roughness Rz of the elastic layer of the intermediate transfer belt is approximately the average particle size of the toner or more, the transfer efficiency is abruptly deteriorated, too.

Furthermore, FIGS. 10 and 11 are each a table to show the results obtained by comparing the case where a surface layer is not made of an expanded body using a supercritical method (Preparation Method 1) but prepared by coating a rubber layer and then polishing it (Preparation Method 2); the case where a surface layer is prepared by changing a thickness of an elastic layer from 200 μm to 100 μm; and the case where a surface layer is prepared by further changing a hardness of the elastic surface layer from 500 to 80° (partially including ones having a hardness of 10°). In all of the cases, it is understood that in the case where the center point average roughness and the ten-point average roughness are substantially equal to each other, the same results are obtained; and that the present embodiment can be applied within the foregoing ranges. Furthermore, Belts 33 to 37 are concerned with a comparative example in which the belt is made of a single-layered polyimide, the surface of which is polished and is not an elastic layer. In Belts 33 to 37, both the scattering at the time of transfer (line width having an ID of from 0.2 to 1.0) and the transfer efficiency are deteriorated. Thus, it is understood that an elastic surface layer which is an elastic body and which has a prescribed roughness is necessary as in the present embodiment.

As described above, it is evident that when the sphericity of the toner increases, the effect of the present embodiment is revealed. It is clear that when the toner is a true sphere, a larger effect should be brought.

Second Embodiment

Next, a second embodiment of the invention is described.

The present embodiment is a modification of the foregoing first embodiment. The present embodiment is different from the first embodiment with respect to the roughness condition of the belt surface of the intermediate transfer belt and the configuration in the vicinity of the transfer position. Portions having the same functions as the portions mentioned in the first embodiment are given the same symbols, and their explanations are omitted.

Incidentally, in the present embodiment, a development unit configuring a part of the process unit also develops an electrostatic latent image on an image carrier by using a toner having a shape factor SF-1 in the range of from 100 to 130 and a shape factor SF-2 in the range of from 100 to 140.

It has already been described that when the ten-point surface roughness Rz of the intermediate transfer belt is larger than the volume average particle size of the toner, in transferring a toner image from the intermediate transfer belt to the transfer medium such as paper, the transfer efficiency is lowered. As a countermeasure against this, the present embodiment is configured such that an ultrasonic generator which irradiates ultrasonic waves (vibration imparting section or vibration imparting unit) is provided at a prescribed transfer position which transfers a toner image from the intermediate transfer belt to the transfer medium such as paper or in the vicinity thereof; that a vibration is given to the toner to be carried on the intermediate transfer belt by only the irradiation with ultrasonic waves or in combination with voltage application by a transfer bias voltage application section; and that the toner image is transferred while controlling falling of the toner into irregularities of the intermediate transfer belt surface.

Figure 12:
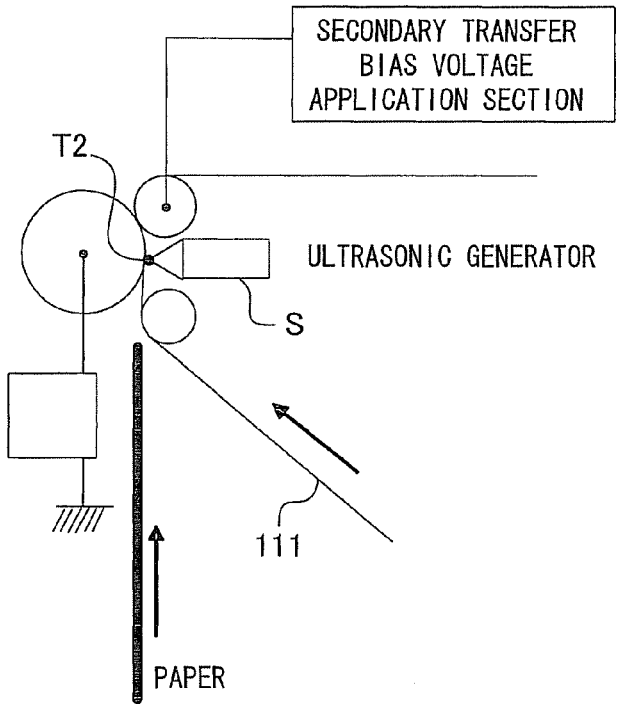
FIG. 12 is a view to show a configuration example in the vicinity of a transfer position of a toner image to paper in an image forming apparatus according to a second embodiment of the invention.

A configuration example of the transfer section to paper is illustrated in FIG. 12. An ultrasonic generator S is placed on the back surface of the intermediate transfer belt in a transfer nip section and is operated at substantially the same timing with a transfer electric field, with its tip being in contact with or close to the vicinity of a transfer position T2 of the intermediate transfer belt. As an applied frequency by the ultrasonic generator S, from approximately 20 kHz to 500 kHz can be employed. According to this, the toner is floated from recesses of the roughness of the surface of the intermediate transfer belt by the vibration, and even when the surface roughness of the intermediate transfer belt is relatively large, good secondary transfer becomes possible. Furthermore, while the toner on the intermediate transfer belt is vibrated by ultrasonic waves, since the vibration takes place inside the nip, the transfer scattering does not increase. In this way, by irradiating ultrasonic waves to the belt from the inside of the intermediate transfer belt, it is possible to effectively release the toner which has fallen into irregularities of the surface of the intermediate transfer belt. Furthermore, by arranging the ultrasonic generator S in the inside of the intermediate transfer belt, it is not necessary to provide a special arrangement space, and such a configuration is able to contribute to saving of a space as the whole of apparatus.

Figure 13:
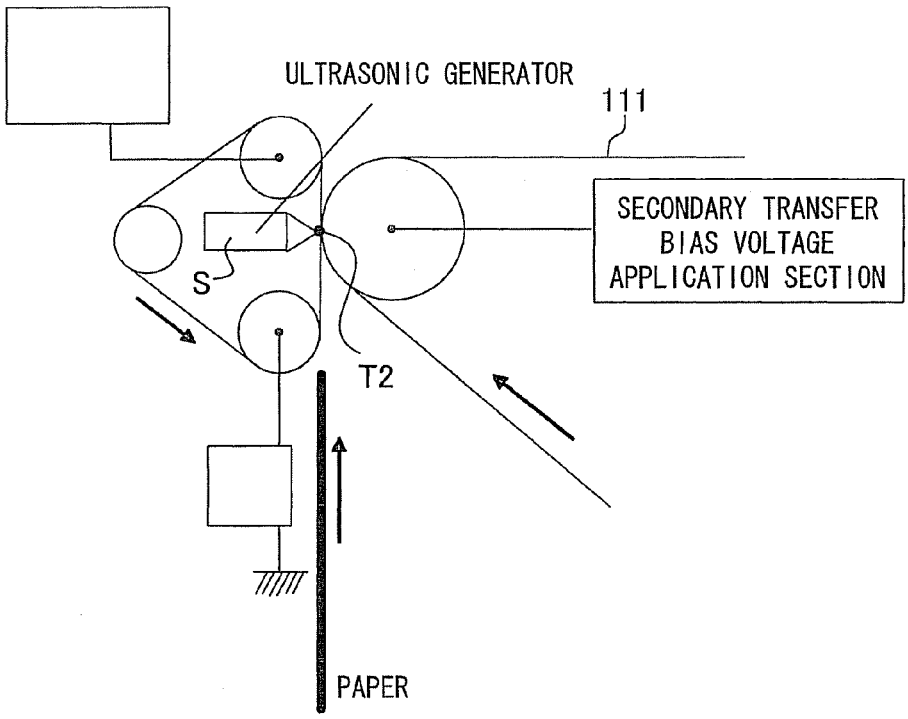
FIG. 13 is a view to show other configuration example of a secondary transfer position.

FIG. 13 is a view to show other configuration example of a secondary transfer position. In the transfer nip section, since it is only required to give ultrasonic waves, for example, a configuration in which an opposing member to the secondary transfer section is in a belt-like form and ultrasonic waves are given from its back surface can be taken.

Figure 14:
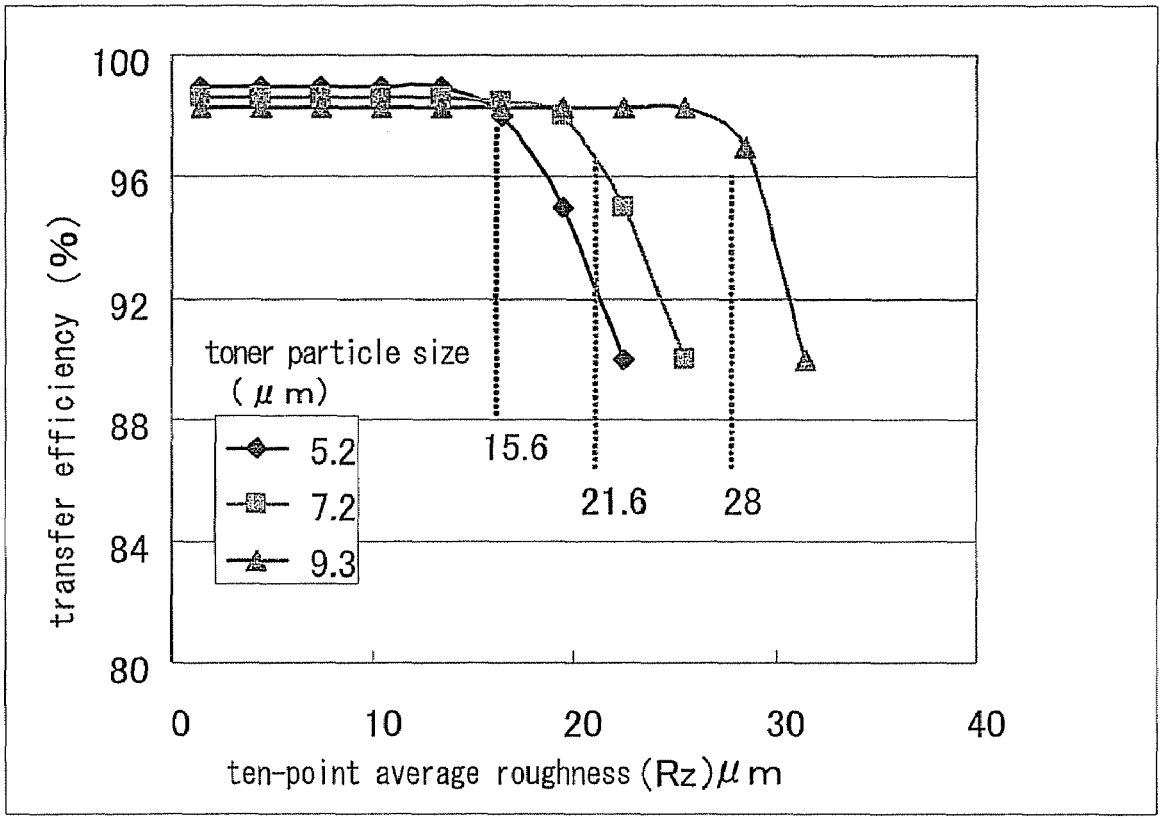
FIG. 14 is a graph to show the results obtained by measuring a secondary transfer efficiency in the configuration of FIG. 12.

FIG. 14 is a graph to show the results obtained by measuring a secondary transfer efficiency in the configuration of FIG. 12. A relatively spherical toner having shape factors SF-1 and SF-2 of 110 and 110, respectively was used as the toner. As compared with the state as shown in FIG. 7, it is understood that by assisting the transfer by ultrasonic waves, not only the transfer efficiency is enhanced as a whole, but also a threshold value at which the transfer efficiency is lowered is shifted to an increasing direction.

As described above, in the case where an ultrasonic generator is not used, the ten-point average roughness of the elastic surface layer of the intermediate transfer belt must be not more the volume average particle size of the toner, whereas by using the ultrasonic generator S, even when the ten-point surface roughness Rz increases to approximately 3 times of the volume particle size of the toner, it is possible to realize good transfer.

Accordingly, in the present embodiment, the surface roughness of the elastic surface layer of the intermediate transfer belt is set up so as to have a center point average roughness of 0.1 times or more of the volume average particle size of the used toner and a ten-point average roughness of not more than 3 times of the volume average particle size of the used toner.

The thus described embodiment is especially effective in the case of a combination with a cleaner-less process of the photoconductor.

In the cleaner-less process, a cleaning blade which removes the toner attached to the surface of the photoconductor is not provided. In such a cleaner-less process, the photoconductor is not shaven. On the other hand, when the carrier attaches to the side of the photoconductor in the development section, the attached carrier remains on the photoconductor without being cleaned and is sandwiched between the intermediate transfer belt and the photoconductor at the transfer position, thereby possibly damaging the surface of the photoconductor.

Furthermore, since blade cleaning is not performed, there is involved a problem that the surface of the photoconductor is not cleaned, whereby a part of the toner adheres to the surface to generate an image defect. On the other hand, in the present embodiment, since the surface of the intermediate transfer belt is made of an elastic body, there is brought an effect that even when the carrier is lodged between the intermediate transfer belt and the photoconductor, the side of the photoconductor is hardly damaged.

In addition, according to the intermediate transfer belt of the present embodiment, since a transfer pressure can be consequently decreased, a stress which the photoconductor receives at the transfer position due to the toner can be reduced, and the adhesion of the toner to the surface of the photoconductor can be suppressed.

Furthermore, in the cleaner-less process, since a cleaning blade is not provided, it is required that the transfer efficiency is high. In order to enhance the transfer efficiency, it is preferred to use a spherical toner. However, when a spherical toner is used, the scattering at the time of transfer was of a problem in a related-art image forming apparatus. The reason why the spherical toner is liable to be scattered at the time of transfer in the related-art image forming apparatus resides in the matter that the adhesive force of the toner is weak. Thus, it may be said that the transfer efficiency is high just because the adhesive force is weak.

Then, by applying the present embodiment, it becomes possible to solve the problem of the cleaner-less process using a spherical toner consequently. Furthermore, in a color cleaner-less process, the generation of reverse transfer is a cause of color mixing. In this issue, the present embodiment is also effective because when the toner is stacked, excessive discharging in the inside of the transfer nip can be suppressed.

Figure 15:
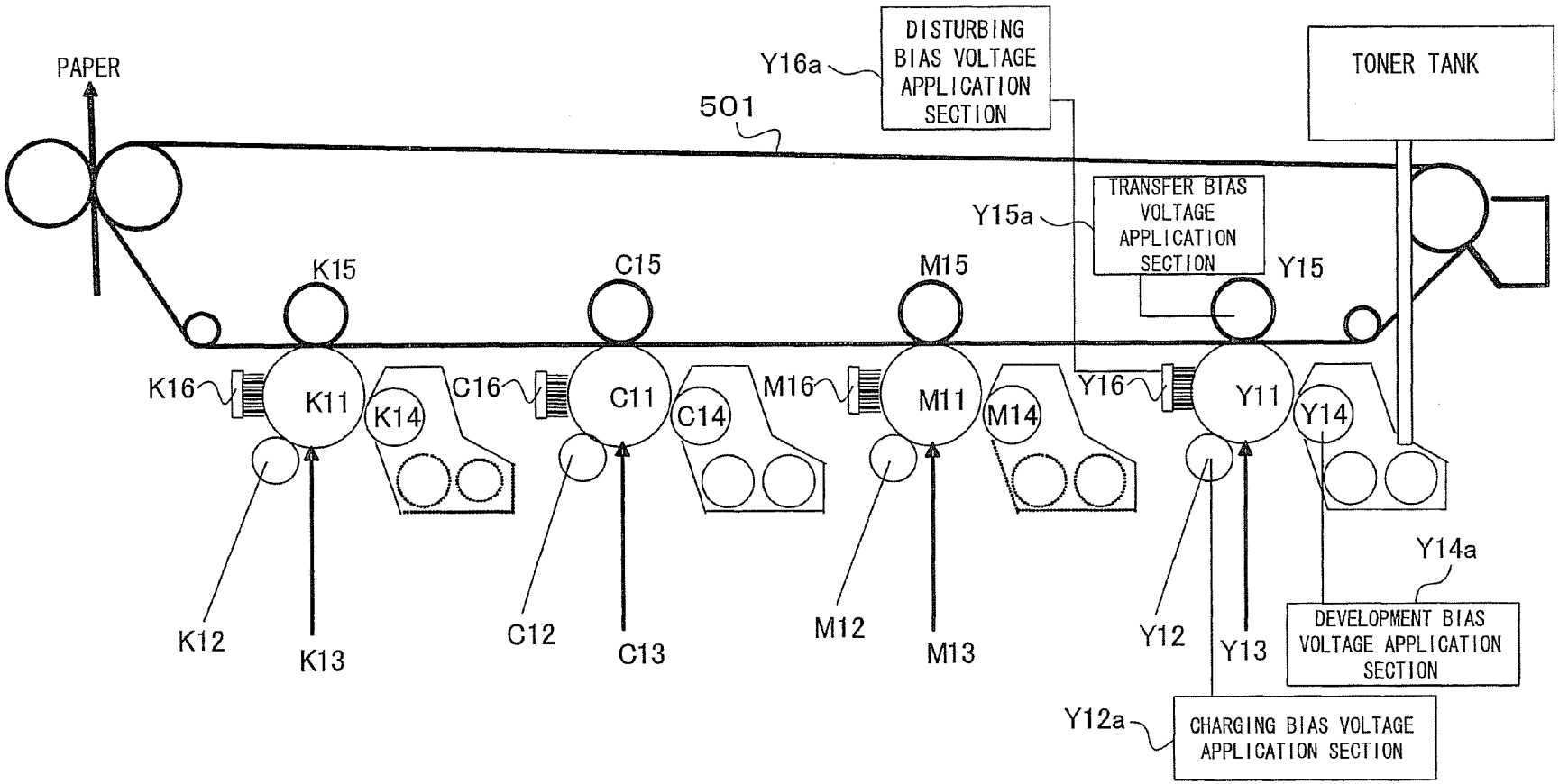
FIG. 15 is a view to show a configuration example of a cleaner-less process.

FIG. 15 is a view to show a configuration example of a cleaner-less process.

Figures 17, 18:
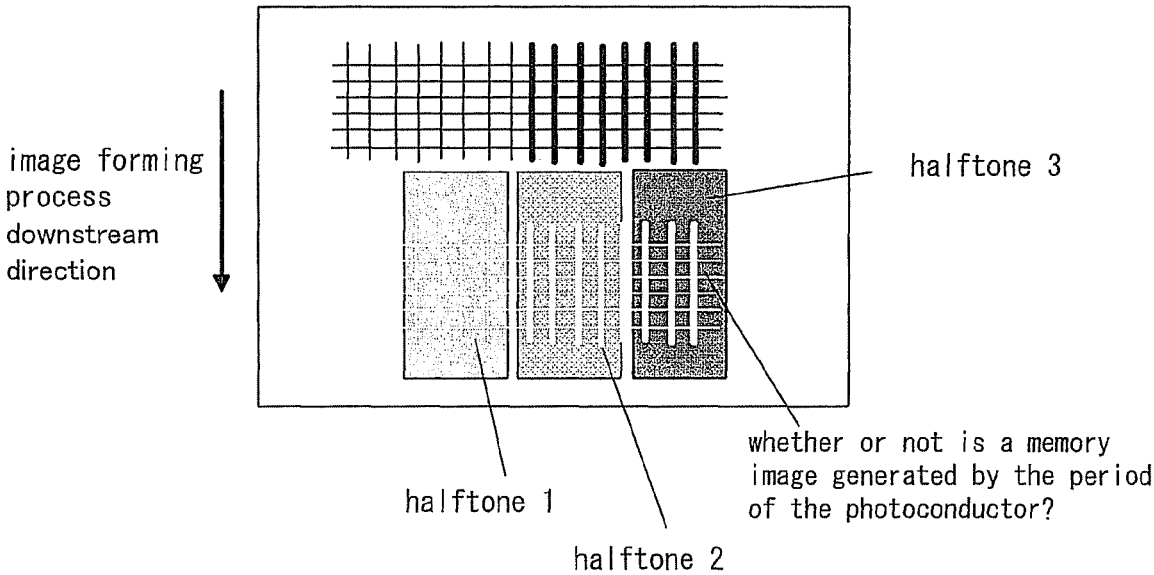
FIG. 17 is a view to show one example of a memory chart.
FIG. 18 is a table to show the experimental results in the case of using a charging roller in a charging unit of a photoconductor.

FIG. 15 illustrates a configuration in which disturbing members K16, C16, M16 and Y16 disturbing the residual transfer toner are provided at a position of a cleaning blade of a related-art photoconductor. Furthermore, FIG. 16 is a table to show the results of a continuous printing test in the case where the present embodiment is applied. The test was carried out by continuously passing paper while printing at a printing ratio of 5% in an overlapping portion with yellow in a cyan station in a state of printing an image at a printing ratio of 25% in a yellow station. First of all, after printing of 20,000 sheets in a normal temperature and normal humidity environment (at 21° C. and 50%), printing of 10,000 sheets was performed in a high temperature and high humidity environment (at 30° C. and 80%), and printing of 10,000 sheets was further performed in a low temperature and low humidity environment (at 10° C. and 20%), thereby measuring the state of ID unevenness of a halftone image or the like and a color difference (ΔE) of a cyan image from the initial state. The color difference was measured by using X-rite (registered trademark). Also, a line image of 1 dot line of 600 dpi was periodically printed, thereby measuring a width of line width (ID: 0.2 to 1.0) due to scattering of the toner. In addition, a chart as illustrated in FIG. 17 was periodically printed, too. In the cleaner-less process, when the amount of the residual transferred toner on the photoconductor is large, there is a possibility that a history of image (memory image) printed just before the printing appears in the halftone portion. The chart as illustrated in FIG. 17 is a charge image to be printed for the purpose of confirming such a memory image and is called a memory chart.

In the halftone image, in the case where a white spot or a streak is generated, a possibility that the surface of the photoconductor is damaged by the carrier or that a part of the toner adheres to the surface of the photoconductor is high, and the evaluation was visually made and graded as "○ΔX". "Δ" means that while the generation of a white spot or a streak can be visually confirmed, it is on a level within a tolerable range; and "X" means that the generation of a white spot or a streak is on a problematic level as an image defect.

Furthermore, with respect to the color difference of the cyan image from the initial state, it is understood that the larger the subject color difference, the larger the amount of the reversely transferred toner. It is considered that when ΔE is generally less than 6, a large problem is not caused, an aspect of which, however, varies depending upon a printing condition. In the case where the amount of the reversely transferred toner is large, it is expected that an excessive discharging phenomenon or the like is generated at the transfer position. Furthermore, with respect to the line width due to the toner scattering in the line image, as described previously, it is understood that when it is a little, a sharp image quality is achieved. With respect to the memory chart, it is meant that in the case where a memory is generated, the amount of the residual transferred toner is too large, whereby the cleaner-less process is not satisfactorily established. This was also evaluated in terms of "○ΔX". The case where a memory cannot be visually confirmed is designated as "○"; the case where while a memory is visually noted, a reflection density difference (ΔID) on the halftone is less than 0.05 is designated as "Δ"; and the case where a reflection density difference (ΔID) on the halftone is 0.05 or more is designated as "X".

A toner having a volume average particle size of 5.2 μm was used as the toner, and comparison was made with respect to three kinds of toners having a different sphericity regarding the shape factor. FIG. 16 shows the experimental results. In a toner having a high sphericity (SF-1: 110, SF-2: 110), in the case of applying the intermediate transfer belt (Belt 2) of the present embodiment, no problem was observed in the halftone after printing of 40,000 sheets in total, and the color difference (ΔE) fell in approximately 5. The line width is stable as not more than 40 μm, and the transfer scattering is suppressed. In addition, a memory is not generated, and therefore, it is noted that the reproduction of an image with high image quality can be continued in the cleaner-less process.

Here, even by using a toner having a slightly reduced sphericity (SF-1: 130, SF-2: 140), so far as it still falls within the range as in the present embodiment, while a memory which is considered to be caused due to a poor transfer efficiency is slightly generated, the results which do not substantially bring a problem are obtained. However, in a non-spherical toner (SF-1: 140, SF-2: 150), the memory chart becomes "NG", and the amount of the reversely transferred toner increases so that the color difference tends to increase. Furthermore, in the case of a polyimide belt which is a related-art hard belt having a single-layered configuration used for comparison, streak unevenness is generated in the halftone image due to damages of the photoconductor; and in the spherical toner, since the scattering is deteriorated and the transfer nip is unstable, the amount of the reversely transferred toner is large, and the color difference becomes large.

Furthermore, in a type of a hard polyimide belt provided with a surface roughness (Belt 33), though the transfer scattering is liable to be suppressed, the streak unevenness of the halftone and the color difference were deteriorated as they were. Moreover, in a belt in which while an elastic surface layer is provided, the center point average roughness is less than the condition of the present embodiment and the surface roughness is insufficient (Belt 12), though the level of the scattering was worse, other items were on an "OK" level. As described above, when the invention is applied to a cleaner-less process, it is understood that a good image can be obtained over a long period of time.

Furthermore, FIG. 18 is a table to show the experimental results in the case of using a charging roller in a charging unit of a photoconductor. A concrete apparatus configuration is the same as that as illustrated in FIG. 1. Usually, in addition to a desired DC bias which is intended to be charged, an AC bias having a peak-to-peak voltage of 1,000 V or more is applied to a charging roller, thereby improving the charging stability. However, when such a high AC bias is applied, there is caused a problem that a large quantity of ozone is generated in the vicinity of the surface of the photoconductor, thereby deteriorating the surface of the photoconductor or generating oscillating noises of the AC bias. Then, though it is desired to stably charge the photoconductor by only a DC bias, in the case of only a DC bias, a surface potential of the photoconductor prior to charging is liable to give influences, and therefore, it is required that the potential of the photoconductor after transfer is stable.

In the present embodiment, it has already been described that even when the toner layer is of a stack structure, a good and stable transfer nip can be formed so that abnormal discharging or the like is hardly generated in the transfer nip. According to this effect, even when the bias to be applied to the charging roller is only a DC bias, it becomes possible to achieve stable charging as compared with the related art, and high image quality can be realized.

FIG. 18 is a table to show the experimental results obtained by printing a memory chart used in a test of a cleaner-less process. A toner having a volume average particle size of 5.2 μm is used as the toner and has shape factors SF-1 and SF-2 of 110 and 110, respectively.

Since a cleaner is provided, a memory due to the residual transferred toner is not generated. However, since there is a potential difference in the photoconductor between an image part and a non-image part, when this remains as potential unevenness at the time of next charging, a memory is similarly generated. In a low temperature and low humidity environment in which influences of discharging are liable to be brought, a memory chart was printed on 20 sheets, and comparison on how many sheets could be visually confirmed the memory was made. According to the results, in an intermediate transfer belt to which the invention was applied (Belt 2), even by applying only a DC bias as the charging roller bias, the number of sheets on which the memory could be confirmed was only two. On the other hand, in a single-layered polyimide belt of the related art, the memory could be visually confirmed on eight of the twenty sheets. Regardless of whether or not the intermediate transfer belt of the present embodiment is used, it is understood that though a surface potential of the photoconductor before a transfer section differs between an image part and a non-image part, in the case of applying the invention, influences of a difference in level due to the presence or absence of the toner in the transfer section become a little, whereby the generation of a memory is consequently suppressed in response to the non-generation of abnormal discharging.

Incidentally, for the purpose of preventing the matter that the toner carried on the intermediate transfer belt falls into recesses on the belt surface, the foregoing embodiment is configured to irradiate ultrasonic waves at a prescribed transfer position. However, it should not be construed that the invention is limited thereto, but a prescribed AC bias voltage can be applied to the transfer roller.

Furthermore, with respect to the development system of a toner image, in the foregoing embodiment, there has been enumerated an example of a so-called quadruple tandem system for forming toner images of plural colors at once on an intermediate transfer body rotating once. However, it should not be construed that the invention is limited thereto. A four-rotation intermediate transfer system for successively forming a toner image of each color on an intermediate transfer body rotating four times, and the like can be employed.

Furthermore, by employing a configuration for recovering a transferred residual toner remaining on a photoconductor after transferring a toner image from a photoconductor onto an intermediate transfer belt by a development unit in each process unit, it is possible to realize a complete cleaner-less process.

Furthermore, in the foregoing embodiment, there has been enumerated an example in which the intermediate transfer body is a belt. Besides, a configuration of using an intermediate transfer roller can also be employed. In that case, the elastic surface layer is corresponding to a roller surface of the intermediate transfer roller.

By applying an elastic surface layer for the surface layer of the intermediate transfer belt as in the present embodiment, in secondarily transferring a toner image on the intermediate transfer belt onto paper having irregularities, it is said that secondary transfer with excellent follow-up properties and high image quality against rough paper can be realized as compared with the case of a hard belt such as resin belts.

In the light of the above, in the color image forming apparatus using the intermediate transfer belt, by configuring the surface of the intermediate transfer belt by an elastic body having a surface roughness of a prescribed value or more, it is possible to suppress the movement of the toner on the transfer belt towards the lateral direction against discharging generated before and after the transfer nip. In addition, in the nip, by widening a pressure margin of transfer at the same time of making the generation of discharging itself hard, especially in a toner having a high sphericity, it is possible to synthetically reduce remarkably scattering or hollow defects at the time of transfer.

Furthermore, by applying the elastic intermediate transfer belt of the present configuration to a cleaner-less process, it is possible to use a spherical toner while suppressing scattering, thereby minimizing the amount of the transferred residual toner. In addition thereto, even when the carrier attaches onto the surface of the photoconductor, not only the photoconductor is hardly damaged, but also a stress at the transfer position against the photoconductor can be reduced so that damages on the photoconductor and the adhesion of the toner can be reduced. In addition, in the present embodiment, since abnormal discharging within the nip can be suppressed, the amount of the reversely transferred toner decreases. Thus, color mixing which is a problem inherent to the color cleaner-less process is hardly generated, and high image quality can be kept over a long period of time.

Furthermore, as described previously, since abnormal discharging at the time of transfer is suppressed as compared with the related art, scattering of the surface potential of the photoconductor after it has passed through the transfer position is small, and even in a contact charging member, it is also possible to stably charge the photoconductor by only a DC bias.

While the invention has been described in detail and with reference to specific embodiments thereof, it will be apparent to one skilled in the art that various changes and modifications can be made therein without departing from the spirit and scope thereof.

As described above in detail, according to the invention, it is possible to provide a technology capable of suppressing the generation of transfer scattering of a toner image on an intermediate transfer body and contributing to an improvement in image quality in an image forming apparatus employing an intermediate transfer system.

What is claimed is:

1. An image forming apparatus, comprising:

an intermediate transfer body to which a toner imager is transferred from an image carrier, the intermediate transfer body having an elastic surface layer having a center point average roughness of 0.1 times or more of a volume average particle size of a used toner and a ten-point average roughness of not more than the volume average particle size of the used toner; and a development section which develops an electrostatic latent image on the image carrier by using a toner having a shape factor SF-1 in the range of from 100 to 130 and a shape factor SF-2 in the range of from 100 to 140.

2. The image forming apparatus according to claim 1, wherein the elastic surface layer of the intermediate transfer body is made of an expanded elastic material.

3. The image forming apparatus according to claim 1, wherein the elastic surface layer of the intermediate transfer body is provided by spray coating on a substrate.

4. The image forming apparatus according to claim 1, wherein the elastic surface layer of the intermediate transfer body is formed of an elastic material having an Asker-C hardness of from 10° to 80°.

5. The image forming apparatus according to claim 1, wherein the transferred residual toner remaining on a photoconductor after transferring a toner image from the photoconductor onto the intermediate transfer body is recovered in a development section.

6. The image forming apparatus according to claim 1, wherein a charging member of a photoconductor is a contact charging member to which a DC bias is applied.

7. An image forming method, which comprises:

developing an electrostatic latent image on an image carrier by using a toner having a shape factor SF-1 in the range of from 100 to 130 and a shape factor SF-2 in the range of from 100 to 140; and transferring a toner image formed on the image carrier to an intermediate transfer body having an elastic surface layer having a center point average roughness of 0.1 times or more of a volume average particle size of the used toner and a ten-point average roughness of not more than the volume average particle size of the used toner.

8. The image forming method according to claim 7, wherein the elastic surface layer of the intermediate transfer body is made of an expanded elastic material.

9. The image forming method according to claim 7, wherein the elastic surface layer of the intermediate transfer body is provided by spray coating on a substrate.

10. The image forming method according to claim 7, wherein the elastic surface layer of the intermediate transfer body is formed of an elastic material having an Asker-C hardness of from 10° to 80°.

11. The image forming method according to claim 7, wherein the transferred residual toner remaining on a photoconductor after transferring a toner image from the photoconductor onto the intermediate transfer body is recovered in a development section.

12. The image forming method according to claim 7, wherein a charging member of a photoconductor is a contact charging member to which a DC bias is applied.

* * * * *